United States Patent [19]

Ewig

[11] 4,349,143

[45] Sep. 14, 1982

[54] ELECTRIC STAPLER AND DRIVER ASSEMBLY THEREFOR

[75] Inventor: John F. Ewig, Worcester, Mass.

[73] Assignee: Parker Manufacturing Co., Worcester, Mass.

[21] Appl. No.: 148,721

[22] Filed: May 12, 1980

[51] Int. Cl.[3] ..... B25C 5/15

[52] U.S. Cl. ..... 227/131; 227/134

[58] Field of Search ..... 227/130, 131, 134, 145; 335/256, 268

[56] References Cited

U.S. PATENT DOCUMENTS

| | | | |
|---|---|---|---|
| 2,432,853 | 12/1947 | Barclay | 227/145 X |
| 2,975,424 | 3/1961 | Oussani . | |
| 3,016,538 | 1/1962 | Oussani | 227/131 X |
| 3,017,636 | 1/1962 | Koennecke . | |
| 3,041,618 | 7/1962 | Ruskin et al. | |
| 3,058,117 | 10/1962 | Moore . | |
| 3,141,171 | 7/1964 | Doyle et al. | |
| 3,179,866 | 4/1965 | Doyle et al. | |
| 3,215,864 | 11/1965 | Doyle et al. | |
| 3,267,337 | 8/1966 | Doyle et al. | |
| 3,278,101 | 10/1966 | Hatazaki . | |
| 3,345,546 | 10/1967 | Beltramo | 227/131 X |
| 3,347,438 | 10/1967 | Doherty . | |
| 3,347,440 | 10/1967 | Doherty . | |
| 3,434,026 | 3/1969 | Doyle | 227/131 X |
| 3,482,754 | 12/1969 | Doherty . | |
| 3,576,473 | 4/1971 | Genbauffe et al. | 335/268 X |
| 3,589,587 | 6/1971 | Manganaro . | |
| 3,766,455 | 10/1973 | Zakrewsky . | |
| 3,786,978 | 1/1974 | Manganaro . | |
| 3,924,789 | 12/1975 | Avery et al. | 227/131 |
| 4,005,812 | 2/1977 | Doyle et al. | 227/131 |
| 4,033,500 | 7/1977 | Manganaro . | |
| 4,039,113 | 8/1977 | Males | 227/130 |
| 4,119,258 | 10/1978 | Ewig, Jr. | 227/132 |
| 4,183,453 | 1/1980 | Barrett . | |
| 4,196,833 | 4/1980 | Haytayan | 227/148 |

*Primary Examiner*—Howard N. Goldberg
*Assistant Examiner*—Fred A. Silverberg
*Attorney, Agent, or Firm*—Thompson, Birch, Gauthier & Samuels

[57] ABSTRACT

A stapler includes a main body, a magazine portion and a handle. A solenoid with a reciprocatable plunger is mounted within the main body. The plunger is constrained for movement along an axis that is at an acute angle with respect to an axis along which the staples are driven. A driver, which is moved by the plunger, drives a staple into a workpiece. A circuit is provided to permit only one staple to be driven for each actuation of the stapler.

7 Claims, 15 Drawing Figures

ELECTRIC STAPLER AND DRIVER ASSEMBLY THEREFOR

BACKGROUND OF THE INVENTION

It has become common practice, particularly where a considerable amount of stapling is to be done, to use a stapling gun that is operated by electricity. The electric stapler is particularly useful in professional stapling applications, because considerable force is required to operate a hand stapler and this physical activity, when carried on for a long period of time, is very difficult. The electric stapler not only permits operation over long periods of time without the worker becoming tired, but it also allows an even stronger force available for stapling than is possible with a manually-operated stapler. Nevertheless, there are a number of problems that arise in connection with such electric staplers. One problem that is encountered is that it is not possible to staple directly into the corner between a horizontal surface (for instance) and a vertical surface, as around the edge of a carpeting in a room. Also, there are some applications where it is not desirable to use a strong driving power for driving the staple, while in other applications a very strong force is necessary. Also, since most electric staplers are operated by a solenoid and the power available is alternating current, there is a tendency to bounce which can lead to a destruction of the material being stapled and can also result in irregular placing of the staple, as well as double stapling. These and other difficulties experienced with the prior art devices have been obviated in a novel manner by the present invention.

It is, therefore, an outstanding object of the invention to provide an electric stapler capable of placing a staple close to a vertical surface or the like.

Another object of this invention is the provision of an electric stapler having a capability of selectively driving the stapler at a low force or a high force.

A further object of the present invention is the provision of an electric stapler which is solenoid operated, but in which continuous pressure on the operating switch does not cause repeated operation of the stapler.

It is another object of the invention to provide an electric stapler in which an operating solenoid is energized by a single electrical pulse.

With these and other objects in view, as will be apparent to those skilled in the art, the invention resides in the combination of parts set forth in the specification and covered by the claims appended hereto.

SUMMARY OF THE INVENTION

In general, the invention consists of an electric stapler provided with a housing having a main body, a magazine portion, and a handle. The magazine portion has a flat bottom surface which is adapted to lie along the surface of the article to be stapled. The main body extends from one end of the magazine portion and has a substantial end surface lying at a right angle to the bottom surface. A staple magazine is located in the magazine portion to present staples one-by-one to the one end of the main body and a staple driver is mounted in the main body for sliding motion toward and away from the staple. A solenoid is mounted in the main body and has a plunger whose line of reciprocation lies at an acute angle to the end surface of the main body. The plunger is operatively connected to the staple driver. The solenoid has two coils that can be separately or jointly energized to permit a selection between a low-force and a high-force in driving a staple.

More specifically, the staple driver is an elongated metal band which is guided in its reciprocation in a passage formed in the main body. The passage is curved, so that a portion adjacent the one end of the magazine portion would have an imaginary tangent that is parallel to the end surface of the main body and so that the remainder curves away from the end surface. A circuit is provided to permit only one pulse of electrical current to reach the coils when an actuating switch is pressed.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
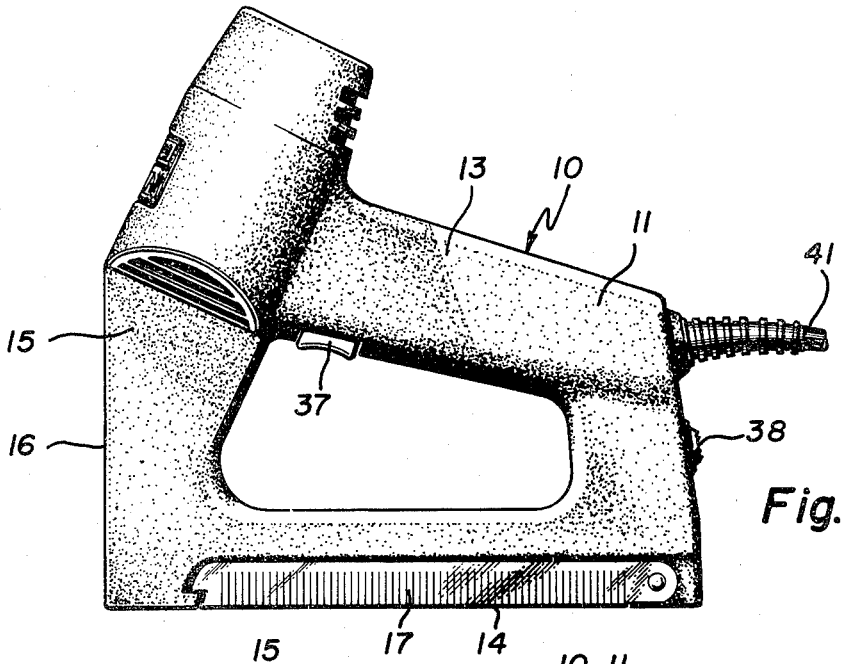
FIG. 1 is a side elevational view of an electric stapler incorporating the principles of the present invention.
Figure 4:
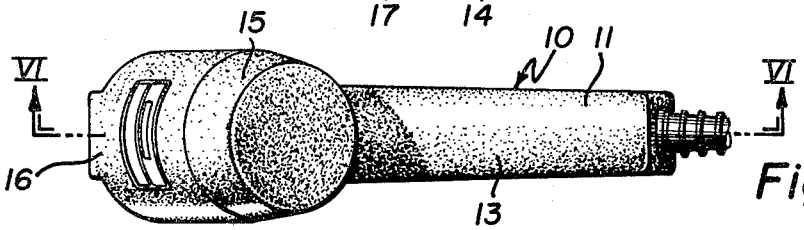
FIG. 4 is a top plan view of the stapler.
Figure 5:
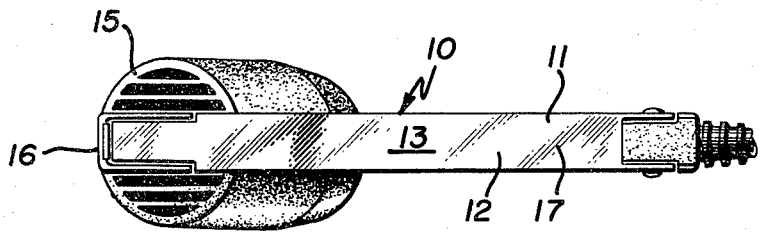
FIG. 5 is a bottom plan view of the stapler.
Figure 2:
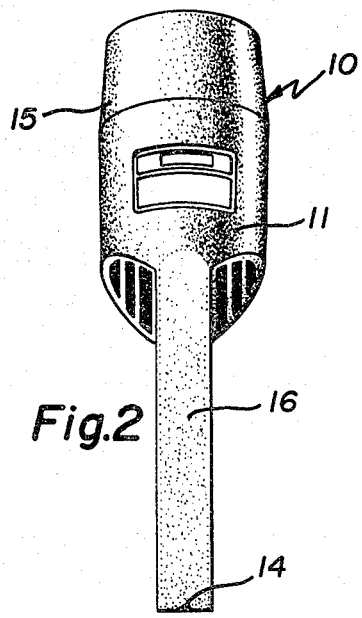
FIG. 2 is a front elevation of the electric stapler.
Figure 3:
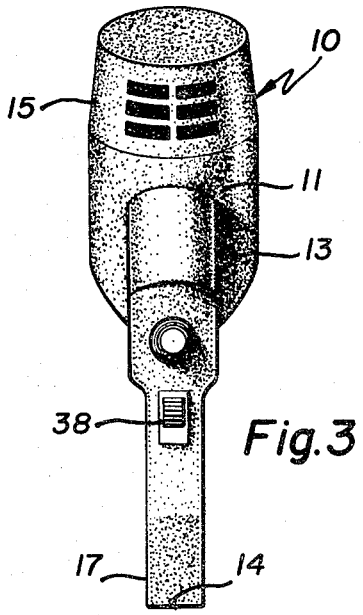
FIG. 3 is a rear elevational view of the stapler.

Referring first to FIGS. 1, 2, 3, 4 and 5, which best show the general features of the invention, it can be seen that the electric stapler, indicated generally by the reference numeral 10, consists of a housing 11 having a main body 15, a magazine portion 12, and a handle 13. The magazine portion 12 is provided with a flat bottom surface 14 which is adapted to lie along the surface of the article into which a staple is to be driven. The main body 15 extends from one end of the magazine portion 12 and has an end surface 16 lying at a right angle of the bottom surface 14. A staple magazine 17 is located in the magazine portion 12 to present staples 18 seriatim to the one end.

Figure 6:
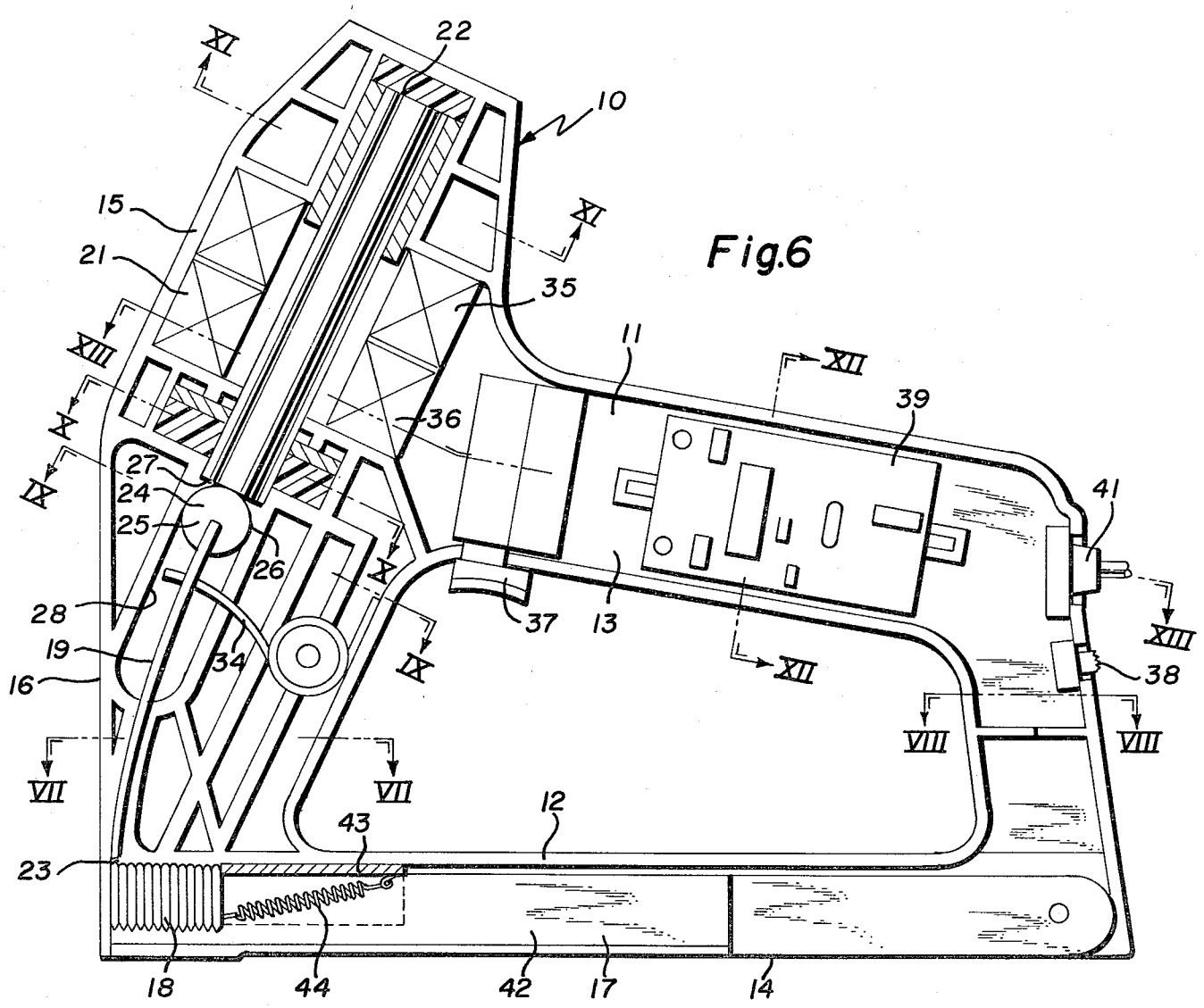
FIG. 6 is a vertical sectional view of the electric stapler taken on the line VI—VI of FIG. 4.
Figure 7:
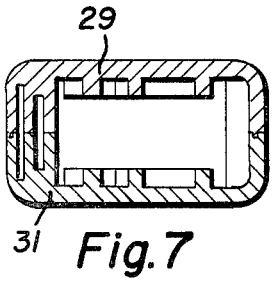
FIG. 7 is a horizontal sectional view of the stapler taken on the line VII—VII of FIG. 6.
Figure 8:
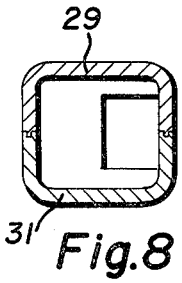
FIG. 8 is a horizontal sectional view of the stapler taken on the line VIII—VIII of FIG. 6.

Referring next to FIG. 6, it can be seen that a staple driver 19 is mounted in the main body 15 for sliding motion toward and away from the one end of the magazine portion 12 for driving staples 18. The solenoid 21 is mounted in the main body 15 and has a plunger 22 whose line of reciprocation lies at an acute angle to the end surface 16 and which is operatively connected to the staple driver 19.

The staple driver 19 is formed as an elongated metal band and the main body is formed with a passage 23 to guide the driver. The passage 23 is curved, so that a portion adjacent the one end of the magazine portion 12 would have an imaginary tangent that is parallel to the end surface 16 of the main body and so that the remainder curves away from the end surface. A connection 24 exists between the plunger 22 and the adjacent end of the staple drive 19 to permit angular misalignment therebetween, the driver flexing as it is driven along the passage by the reciprocation of the plunger. More specifically, the staple driver 19 is provided with nylon head 25 having a cylindrical surface 26 whose axis extends transversely of the length of the driver. The plunger 22 is at least partly formed of nylon and is provided with a transverse flat surface 27 for contact with the cylindrical surface of the head 25.

Figure 9:
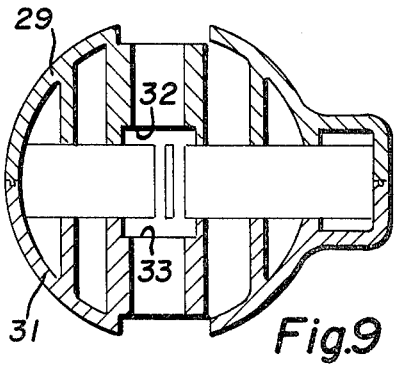
FIG. 9 is a somewhat inclined sectional view of the stapler taken on the line IX—IX of FIG. 6.
Figure 10:
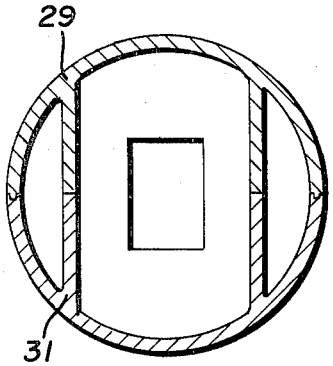
FIG. 10 is a sectional view of the stapler taken on the line X—X of FIG. 6.
Figure 11:
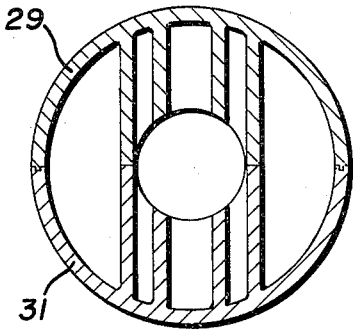
FIG. 11 is a horizontal sectional view of the stapler taken on the XI—XI of FIG. 6.
Figure 12:
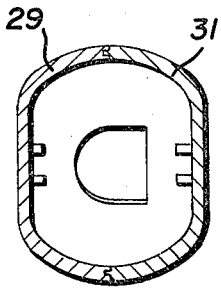
FIG. 12 is a vertical sectional view of the stapler taken on the line XII—XII of FIG. 6.
Figure 13:
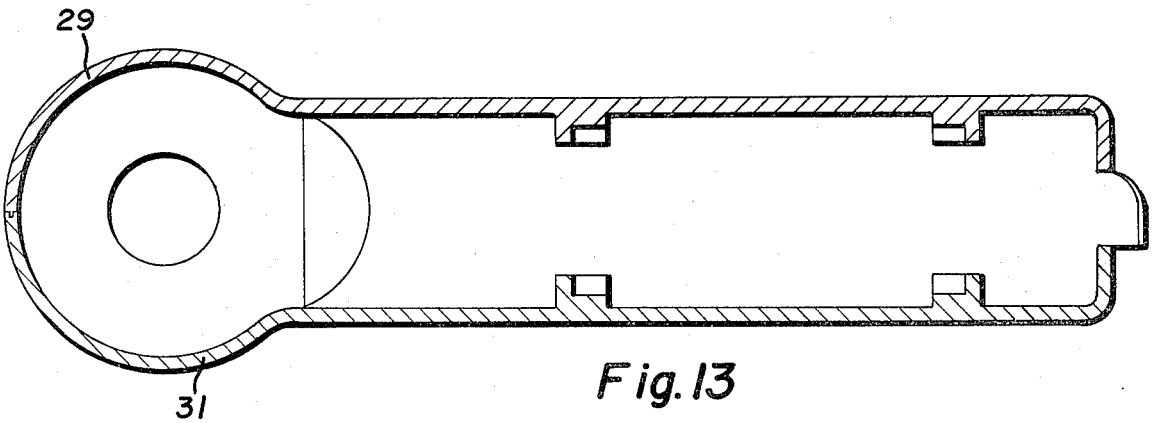
FIG. 13 is a horizontal sectional view of the staple taken on the line XIII—XIII of FIG. 6, and FIGS. 14 and 15 are schematic views of the electrical apparatus contained in the stapler.
Figure 15:
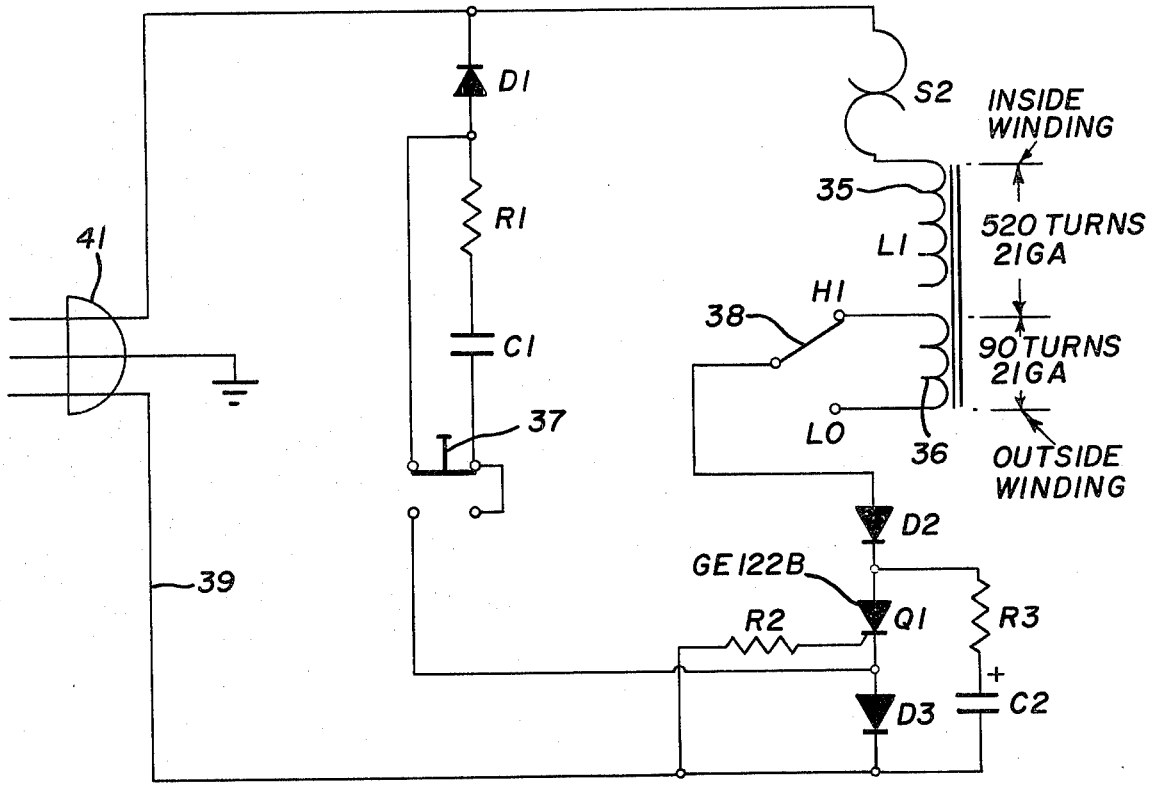

The main body 15 is provided with a second passage 28 of rectangular cross section which is sized to recevie the head 25 in sliding relationship. This second passage is non-coextensive with the first-mentioned passage 23 and has a longitudinal curvature that is generally the extension of the curvature of the first-mentioned passage 23. The housing 11 consists of two substantially mirror-image halves 29 and 31 that are molded of a polymer material. The second passage 28 is formed as facing grooves 32 and 33 (see FIG. 9) in the two halves 29 and 31, respectively, but the passage 23 is entirely formed in one half. A torsion spring 34 acts on the driver 19 to press it normally away from the one end of the magazine.

Figure 14:
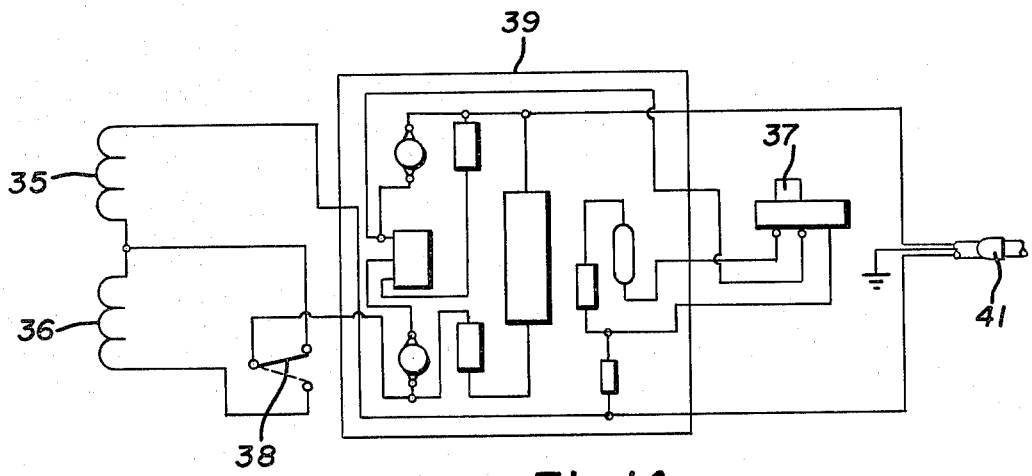

Referring to FIGS. 6 and 14, it can be seen that the solenoid 21 is provided with two coils 35 and 36 which are coaxially mounted and can be separately or jointly energized to permit a selection between a low force and a high force in driving a staple. A normally-open finger switch 37 is mounted on the handle 13 in position to energize the solenoid 21. A selector switch 38 is also mounted on the housing 11 to permit a power source to be connected to either one or both of the two coils 35, 36. A circuit 39 is mounted in the interior of the handle 13 to permit only one pulse of electrical current to reach the coils 35, 36. A cable 41 is provided to connect the housing to a source of 110 volt, alternating-current electricity. The circuit 39 serves to pass only a single half-wave of the current to the selected coil or coils when the finger switch 37 is pressed.

The operation of the invention will now be readily understood in view of the above description. The cable 41 is provided with a plug at its end which is inserted into an outlet providing the stapler with the alternating current electricity. A staple magazine is provided with a supply of staples 18 in the usual manner. The staple magazine is constructed in the manner shown and described in the patent of Ewig U.S. Pat. No. 4,119,258 and is provided with a channel 42 which is straddled by the staples 18. It is also provided with a slide 43 which is biased to the left by a spring 44 (in FIG. 6) to push the staples into position, so that the foremost stapler lies in the passage 23 or the extension thereof. The selector switch 38 is moved to either the "high" position or the "low" position for a selection of stapling force. The stapler is grasped by the handle 13 and is energized by pressing the finger switch 37. Before this is done, however, the surface 14 is pressed against the material to be stapled. If that material is located in a corner (as in stapling a carpet to a floor where the staples must be closely adjacent to the mopboard), then the surface 16 is pressed into the corner to bring the staple release point approximately one-eighth of an inch from that surface.

When the staple is to be driven, the operator squeezes the finger switch 37. When this is done, the control circuit 39 permits the release of one half-wave of current with a positive polarity to one or both of the coils 35 and 36. This causes a movement of the plunger 22 downwardly, so that the surface 27 of the plunger presses against the exterior of the surface 26 of the head 25. The movement of the head causes a similar movement of the driver 19, which then slides down the passage 23. Eventually, the driver reaches the staple 18 which lies in alignment with that passage and drives the staple out of the gun and past the surface 14 into the material to be stapled. During this motion, the head 25 is guided in the second passage 28 with the end surfaces of the head engaging bottoms of the groove 32 and 33 and the cylindrical outer surface 26 engaging the sides of the grooves. Because of the control circuit 39, continued pressing of the finger switch 37 does not cause repeated action of the solenoid 21. On the contrary, no further current passes into the coils until that switch is released. Once that particular staple has been driven, the torsion spring 34 acts on the driver 19, the head 25, and the plunger 22 to return them all to their original positions. Once the driver has been removed from the portion of the passage 23 that is a projection of the staple magazine, the slide 43 presses the supply of staples to the left, so that another staple arrives into alignment with the passage 23.

It can be seen, then, that the particular structure of the present electric stapler permits staples to be placed close to corners, while at the same time allowing the operator to see the position where the staple is to emerge and to regulate it very carefully. There are no large overhanging housings to interfere with this close operation. At the same time, because of the selection between a high force and a low force operation, the operator can, when he is using tough materials, use a high force which will completely drive the staple into place. On the other hand, when dealing with delicate materials, he may wish to reduce this force, so that the staple is not driven entirely through or damage the material. This selection is readily made by use of the selector switch 38.

It is obvious that minor changes may be made in the form and construction of the invention without departing from the material spirit thereof. It is not, however, desired to confine the invention to the exact form herein shown, but it is desired to include all such as properly come within the scope claimed.

The invention having been thus described, what is claimed is new and desired to secure by Letters Patent is:

1. An electric stapler comprising:

(a) a housing having a main body, a magazine portion, and a handle, said magazine portion having a flat bottom surface which is the bottom surface of said stapler and is adapted to lie along the surface of an article to be stapled, said main body extending from one end of said magazine portion and having an end surface lying substantially at a right angle to said bottom surface, said end surface being the forward most surface of said stapler, (b) a staple magazine located in said magazine portion to present staples seriatim to said one end, (c) a staple driver mounted in said main body for sliding motion toward and away from said one end of said magazine portion, and (d) a solenoid mounted in said main body and having a plunger whose line of reciprocation lies at an acute angle to said end surface, said plunger being in contact with said staple driver, wherein the staple driver is an elongated metal band, and wherein the main body is formed with a first passage to guide the staple driver, the first passage being curved, so that a portion adjacent the said one end of the magazine portion would have an imaginary tangent that is parallel to the said end surface of the main body and so that the remainder curves away from the said end surface, said contact between said plunger and said stapler driver is such as to permit angular misalignment therebetween, said staple driver flexing as it is driven along said first passage by the reciprocation of said plunger, wherein said staple driver is provided with a nylon head having a cylindrical surface whose axis extends transversely of the length of said driver, and wherein said plunger is formed of nylon and provided with a transverse flat surface for contact with said cylindrical surface of said head, wherein said main body is provided with a second passage of rectangular cross section sized to receive said head in sliding relationship, said second passage being non-coextensive with said first passage.

2. The electric stapler as claimed in claim 1, wherein said housing consists of two substantially mirror-image halves molded of a polymer material, said second passage being formed as facing grooves in said two halves.

3. The electric stapler as claimed in claim 2, wherein a torsion spring acts on said stapler driver to press it normally away from said one end of the magazine.

4. An electric stapler comprising:

(a) a housing having a main body, a magazine portion, and a handle, said magazine portion having a flat bottom surface adapted to lie along the surface of an article to be stapled, said main body extending from one end of said magazine portion, said one end of said magazine being the forward most end of said stapler, (b) a staple magazine located in said magazine portion to present staples seriatim to said one end approximately one-eighth of an inch from said end, (c) a staple driver mounted in said main body for sliding motion toward and away from said one end of said magazine portion, and (d) a solenoid mounted in said main body and having a plunger which is in contact with said staple driver, said solenoid having two coils that can be separately or jointly energized to permit a selection between a low force and a high force in driving a staple.

5. The electric stapler as claimed in claim 4, incluing a normally-open finger switch mounted on said handle for energizing said coils, a selector switch mounted on said housing for connecting a power source to either one coil or two coils, and a circuit for permitting only one half wave of electrical current to reach the connected coil or coils.

6. The electric stapler as claimed in claim 5, wherein a cable is provided to connect said stapler to a source of alternating current electricity, and wherein said circuit serves to pass a single half-wave of the current to the selected coil when said finger switch is pressed.

7. An electric stapler comprising:

(a) a housing having a main body, a magazine portion, and a handle, said magazine portion having a flat bottom surface which is the bottom surface of said stapler and is adapted to lie along the surface of an article to be stapled, said main body extending from one end of said magazine portion and having an end surface lying substantially at a right angle to said bottom surface, said end surface being the forward most surface of said stapler, (b) a staple magazine located in said magazine portion to present staples seriatim to said one end, (c) a staple driver mounted in said main body for sliding motion toward and away from said one end of said magazine portion, (d) a solenoid mounted in said main body and having a plunger whose line of reciprocation lies at an acute angle to said end surface, said plunger being in contact with said staple driver to permit angular misalignment therebetween, said staple driver flexing as it is driven along said first passage by the reciprocation of said plunger, said solenoid having two coils that can be separately or jointly energized to permit a selection between a low force and a high force in driving a staple, and (e) a circuit connected to said solenoid for permitting only one half wave of electrical current to reach the connected coil or coils.

* * * * *